US009157711B2

(12) United States Patent
Tresserras Torre et al.

(10) Patent No.: US 9,157,711 B2
(45) Date of Patent: Oct. 13, 2015

(54) PELLET FOR SPORTING RIFLES AND SPORTING GUNS

(75) Inventors: Victor Tresserras Torre, Barcelona (ES); Julian Arnedo Vera, Barcelona (ES)

(73) Assignee: GAMO OUTDOOR S.L., Barcelona (ES)

( * ) Notice: Subject to any disclaimer, the term of this patent is extended or adjusted under 35 U.S.C. 154(b) by 8 days.

(21) Appl. No.: 13/817,600

(22) PCT Filed: Mar. 15, 2011

(86) PCT No.: PCT/ES2011/070177

§ 371 (c)(1), (2), (4) Date: Mar. 24, 2014

(87) PCT Pub. No.: WO2012/123595

PCT Pub. Date: Sep. 20, 2012

(65) Prior Publication Data

US 2014/0216294 A1 Aug. 7, 2014

(51) Int. Cl.

| | |
|---|---|
| ***F42B 6/10*** | (2006.01) |
| ***F42B 12/78*** | (2006.01) |
| ***F42B 30/02*** | (2006.01) |

(52) U.S. Cl.

CPC . *F42B 6/10* (2013.01); *F42B 12/78* (2013.01); *F42B 30/02* (2013.01)

(58) Field of Classification Search

CPC ..... F42B 12/34; F42B 12/745; F42B 6/10; F42B 7/046

USPC ..... 102/439, 502, 503, 517, 518, 519, 508

See application file for complete search history.

(56) References Cited

U.S. PATENT DOCUMENTS

| | | | | |
|---|---|---|---|---|
| 4,005,660 | A * | 2/1977 | Pichard | 102/501 |
| 4,251,079 | A | 2/1981 | Earl et al. | |
| 4,869,175 | A * | 9/1989 | McDougal | 102/518 |
| 5,025,730 | A | 6/1991 | Petrovich | |
| 5,038,684 | A * | 8/1991 | Petrovich | 102/515 |
| 5,105,744 | A * | 4/1992 | Petrovich | 102/515 |
| 5,160,805 | A | 11/1992 | Winter | |
| 5,183,963 | A * | 2/1993 | Beaufils et al. | 102/515 |
| 5,214,237 | A * | 5/1993 | McArthur | 102/501 |
| 5,471,719 | A * | 12/1995 | Sawyers | 86/54 |
| 6,244,186 | B1 * | 6/2001 | Pichard | 102/508 |
| 6,526,893 | B2 * | 3/2003 | May et al. | 102/508 |
| 7,337,725 | B2 * | 3/2008 | Queiroz de Aguiar | 102/502 |
| 7,428,871 | B2 * | 9/2008 | Dodson et al. | 102/502 |
| 7,975,590 | B2 * | 7/2011 | Salva | 86/54 |
| 8,037,796 | B2 * | 10/2011 | Salva | 86/54 |
| D683,419 | S * | 5/2013 | Rebar | D22/116 |

(Continued)

FOREIGN PATENT DOCUMENTS

| | | |
|---|---|---|
| EP | 0467819 | 1/1992 |
| FR | 2774162 | 7/1999 |

(Continued)

*Primary Examiner* — Benjamin P Lee

(74) *Attorney, Agent, or Firm* — RatnerPrestia

(57) ABSTRACT

It comprises hollow body (6) with head (2) joined to base (3), in which inside of said hollow body (6) contains tip (4) fixed to referred body (6) characterised in that: tip (4) is fixed in an immobile manner to body (6) and there is at least one lateral space or cavity (5) defined between body (6) and tip (4) and said body (6) is manufactured from an elastic material, at least around the zone where said space or cavity (5) is defined.

19 Claims, 3 Drawing Sheets

(56) References Cited

U.S. PATENT DOCUMENTS

| | | | | |
|---|---|---|---|---|
| 8,438,767 | B2 * | 5/2013 | Rebar | 42/51 |
| 2002/0056218 | A1 | 5/2002 | Salva | |
| 2002/0100389 | A1 * | 8/2002 | May et al. | 102/501 |
| 2004/0244629 | A1 * | 12/2004 | Jopson | 102/508 |
| 2007/0006769 | A1 * | 1/2007 | Dodson et al. | 102/508 |
| 2007/0074637 | A1 * | 4/2007 | Pontieri | 102/501 |
| 2007/0227391 | A1 * | 10/2007 | de Aguiar | 102/502 |
| 2009/0217838 | A1 * | 9/2009 | Salva | 102/508 |
| 2010/0224094 | A1 * | 9/2010 | Salva | 102/517 |
| 2012/0090492 | A1 * | 4/2012 | Rebar | 102/510 |
| 2012/0272855 | A1 * | 11/2012 | Rebar | 102/517 |
| 2014/0230680 | A1 * | 8/2014 | Meller | 102/439 |

FOREIGN PATENT DOCUMENTS

| | | | | |
|---|---|---|---|---|
| GB | 525428 | | 8/1940 | |
| GB | 2269654 | A * | 2/1994 | F42B 6/10 |
| GB | 2279440 | A * | 1/1995 | F42B 6/00 |

* cited by examiner

PELLET FOR SPORTING RIFLES AND SPORTING GUNS

CROSS REFERENCE TO RELATED APPLICATIONS

This application claims the benefit of International Application No. PCT/ES2011/070177 filed Mar. 15, 2011.

A pellet for sporting rifles and sporting gun, of the type comprising a hollow body with a head joined to a base, in which the inside of said hollow body contains a tip fixed to the referred body characterised in that the tip is fixed in an immobile manner to the body and there is at least one lateral space or cavity defined between the body and the tip and said body is manufactured from an elastic material, at least around the zone where said space or cavity is defined.

BACKGROUND TO THE INVENTION

In the state of the art, several pellets and bullets are known that comprise a tip in the form of a ball, the ball of which has a body in the form of a cylinder that is housed inside the pellet.

Thus, there are very old documents that describe a projectile with a ball tip, such as U.S. Pat. No. 1,004,510 "Projectile" from 1910. One of the embodiments comprises a tip with an oval prolongation. Thus, the projectile tip comprises a semi-ball with a prolongation.

U.S. Pat. No. 6,792,869 "Expanding soft tip bullet" is also known from 2004. The purpose of the invention in this patent is an expandable pellet that comprises three parts: a lead base with a cavity covered by a "jacket" and a tip that is at least partially housed inside said cavity. Preferably, the tip is in the form of a ball, but alternative embodiments propose other rounded forms of the tip. It essentially has a cavity inside the pellet body in which the ball can move after the impact. This is what is known as an expandable pellet.

The object of the invention in U.S. Pat. No. 6,964,232 "Bullet with spherical nose portion", held by Olin Corporation (US), which is known and currently in force, is a pellet with a ball tip having predetermined characteristics. A frontal element has a predetermined durability. Moreover, said patent family includes several documents, also in force, that cover various embodiments and also claim the manufacturing procedure.

French patent No FR278068 "Projectile sous calibre, cnemise et expansif pour armes a canons lisses" from 1996, refers to a projectile that comprises three parts: a metal mass, a natural or plastic material cylinder and a jacket, also made of metal. The cylinder and mass are secured inside the metal jacket by retention means.

Patent GB 2269654 "A method of preventing the buildup of deposits of plastics material in a choked and rifled barrel of an air, gas or spring gun", from 1992 is also known, in the name of Mr Earl Hugh EDWARD, which refers to a pellet with a metal head and a plastic tail. The tail has portions that have maximum tail diameters that ensure the pellet will have a low coefficient of friction since it passes through the length of the barrel tube.

BRIEF DESCRIPTION OF THE INVENTION

This invention is an improvement in the pellet sector for sporting rifles and sporting guns.

One of the biggest problems facing pellet manufacturers is how to adjust a determined calibre pellet in the barrel muzzle in order to subsequently fire it.

This detail, which may appear simple, involves many drawbacks due to the large number of sporting rifles and sporting guns manufacturers, so that a simple deviation of some tenths of a millimetre in barrel diameter could mean not hitting the target.

Occasionally, users will force the pellet into the barrel, which damages the pellet and reduces its reliability.

Thus, the closest document is British patent No GB2269654. This patent resolves the problem by fitting a plastic tail to the pellet. Said plastic minimally deforms and can be inserted into a larger number of barrels, but not all, unless the pellet is deformed in which case reliability is lost.

As can be seen, there has been no development in this respect over the last twenty years.

The inventors decided to increase the performance of these pallets to enable them to fit into all barrels of their calibre on the market.

Thus, the new pellet comprises a tip that is fixed in an immoveable manner inside the pellet body so that the tip cannot come loose or move inside the body.

Spaces or cavities are arranged on the side, between the tip and the body. This means that when the tip is inserted inside the body, it defines spaces or cavities on the side.

Lastly, at least the body zones around where the spaces or cavities have been formed, are made of elastic so that, in this way, when the pellet is introduced inside the barrel, the cavities facilitate the body being able to deform elastically sufficiently to fit inside the barrel so that subsequently, when the pellet leaves the barrel after being fired, it can recover and not loose reliability in the shot.

One objective of this invention is a pellet for sporting rifles and sporting guns of the type comprising a hollow body with a head joined to a base, in which the inside of said hollow body contains a tip fixed to the referred body characterised in that the tip is fixed in an immobile manner to the body and there is at least one lateral space or cavity defined between the body and the tip and said body is manufactured from an elastic material, at least around the zone where said space or cavity is defined.

BRIEF DESCRIPTION OF THE DRAWINGS

In order to facilitate the description, this report is accompanied by three sheets of drawings which illustrate a practical embodiment thereof, provided as a non-limiting example of the scope of this invention.

SPECIFIC EMBODIMENT OF THIS INVENTION

Figure 1:
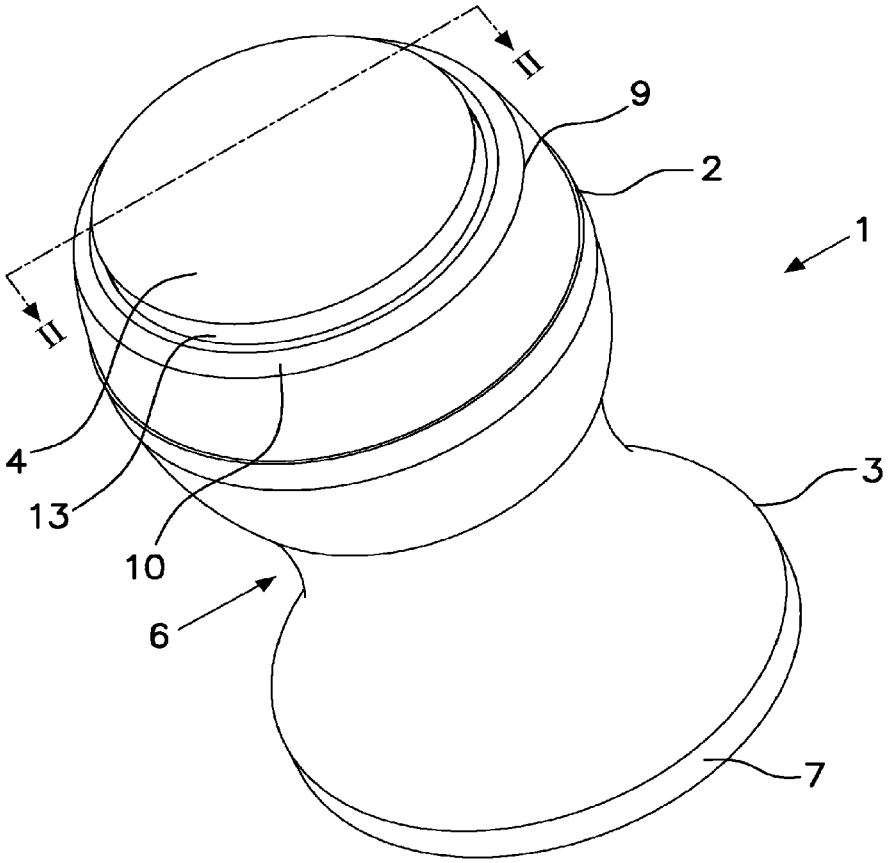
FIG. 1 is a perspective view of the pellet object of by this invention.

In this way, FIG. 1 illustrates pellet 1, body 6 with its head 2 and base 3, a tip 4, and upper zone 9 of head, upper perimeter 10 of head, lateral wall 13 and exterior fins 7.

Figure 2:
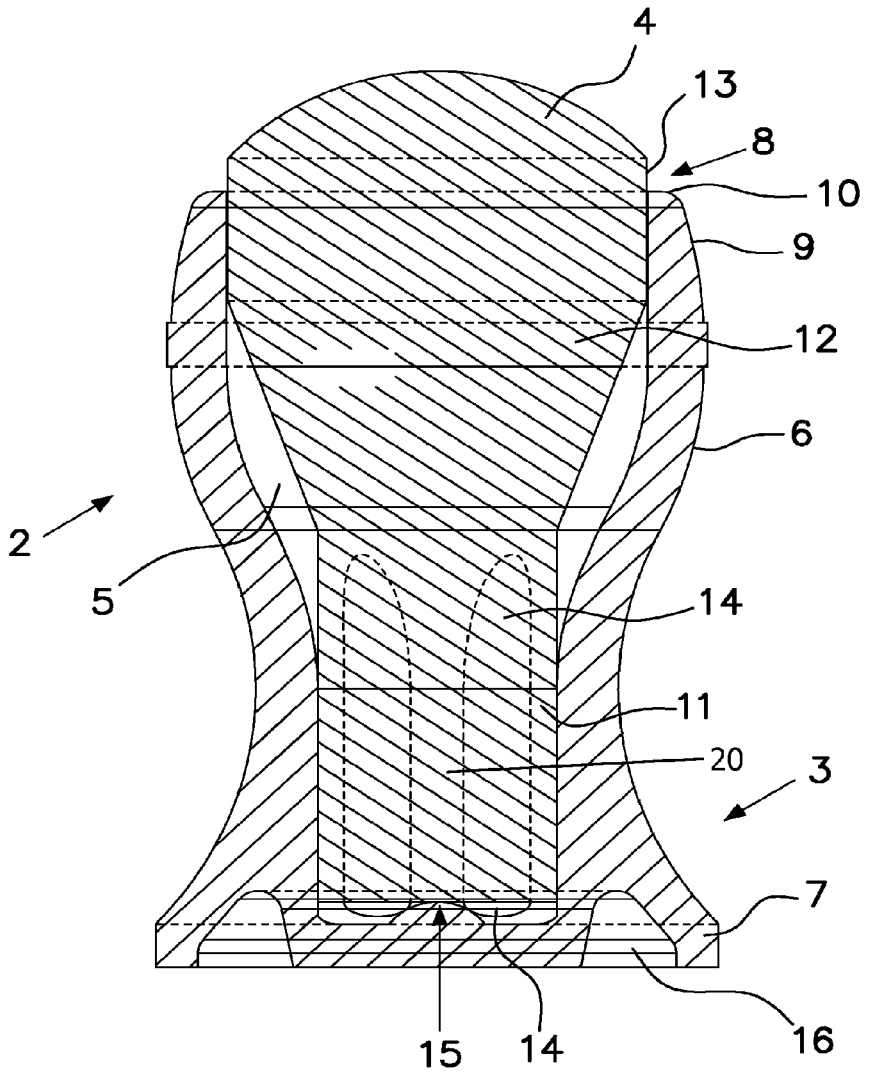
FIG. 2 is a section cut through line II-II on FIG. 1.

FIG. 2 shows head 2, base 3 with its stud 15, tip 4 with its head 12 and its spindle or bar 11, adsorption zone 8, upper zone 9 of head, upper perimeter 10 of head, lateral wall 13, exterior fins 7 that define lower cavity 16, space or cavity 5 and grooves 14.

Figure 3:
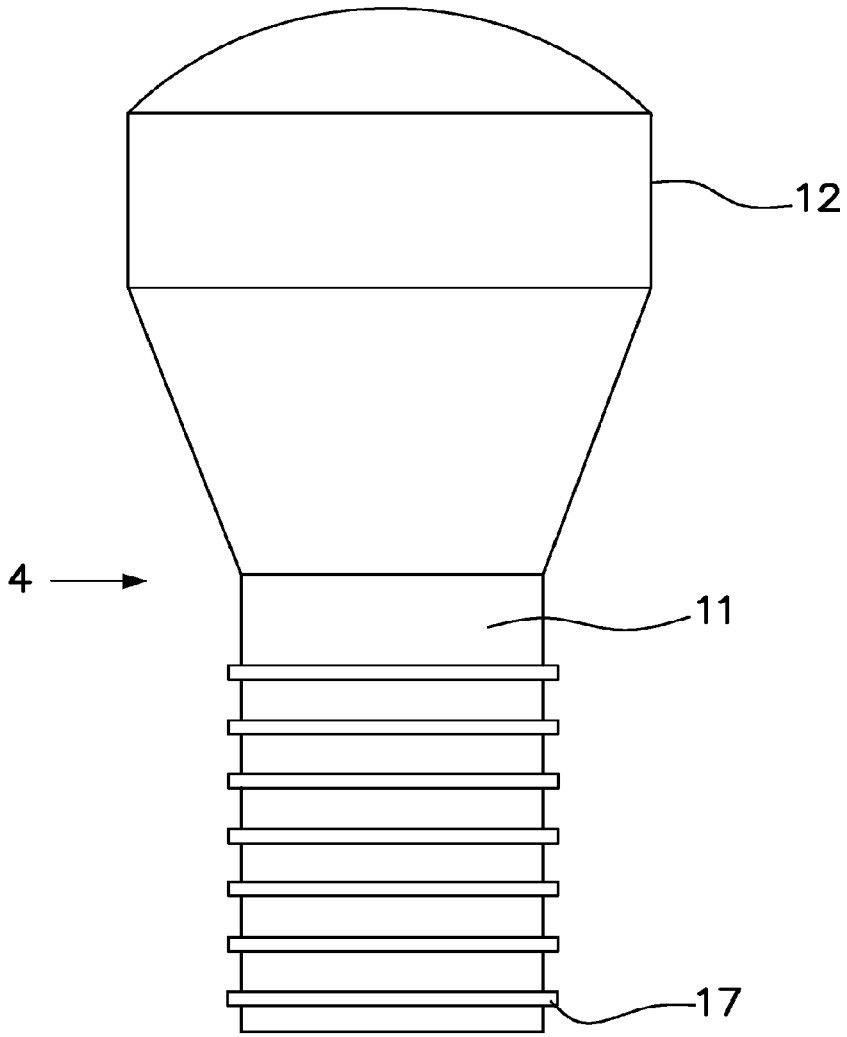
FIG. 3 is a close-up view of a tip.

Lastly FIG. 3 shows tip 4, head 12, spindle or bar 11 and transversal projections 17.

Thus, on a specific embodiment, when the user inserts pellet 1 inside the barrel, specifically the barrel mouth, the pellets adapts to the thickness barrel.

In this way, when inserted into said mouth, the barrel wall exerts pressure on body 6 of pellet 1.

Pellet 1 comprises body 6, which is hollow. It comprises head 2 which is joined to base 3.

The tip 4 is housed inside hollow body 6. Said tip 4 is fixed to body 6 in an unmoveable manner, in other words, it cannot move.

At the same time, when tip 4 is fixed to body 6, at least one space or cavity 5 is defined laterally between cited body 6 and tip 4. The mentioned space or cavity 5 depends on the internal shape of tip 4 and on how body 6 is adjusted, but, in a simpler embodiment it may be arranged as shown in FIG. 2, which defines a space or cavity 5 that is configured in the lower part of head 12 and the beginning of spindle or bar 11.

The part of body 6, which coincides with this zone, where space or cavity 5 is defined, is flexible. This aspect is very significant as will be described below.

For aerodynamic reasons, with respect to the size of pellet 1, parts of body 6 may be wider than upper zone 9 of the body (FIG. 2).

This could mean that when entering head 2 inside the barrel, there may be difficulties to make enter the rest of body 6 of the pellet 1.

Thus, because in the zone where space or cavity 5 is located, body 6 is elastic, it deforms to allow body 6 of pellet 1 to advance inside the barrel without any difficulty.

When pellet 1 is fired, either by air or gas, as pellet 1 exits the barrel body 6 recovers its original shape, in other words, the zone that was elastically deformed recovers its original aerodynamic shape so that the precision and reliability of pellet 1 are not changed, independently of the barrel (of the same calibre) into which it is inserted.

Base 3 may be optionally manufactured from elastic material. It can also be improved using exterior fins 7 that configure a lower cavity 16. This enables fins 7 to be wider than upper zone 9 of head, if so required for aerodynamic reasons, so that they can be deformed elastically and then recover their original aerodynamic shape when they exit the barrel, because lower cavity 16 permits such deformation. This lower cavity 16 is also useful for sealing pellet 1 inside the barrel because the air pressure on base 3 of the pellet causes said lateral fins 7 to press against the barrel wall to increase sealing so that pellet 1 is expelled with greater force.

To increase pellet 1 performance, there is an absorption zone 8 at the end of head 2. This allows adaptation to the various tolerances that may be found here.

Said absorption zone 8 absorbs possible differences in height between body 6 and tip 4. Lateral wall 13 may have greater or lesser height depending on the measurements between the two parts.

In a specific embodiment, absorption zone 8 would consist of a step. Said step is defined by, on the one hand, tip 4 which, in the mentioned absorption zone 8, comprises a lateral wall 13 and, on the other hand, by upper perimeter 10 of head.

Optionally, upper zone 9 of head 2, which is in contact with tip 4, was designed so that it is manufactured using reinforced material to provide tip 4 with rigidity.

Tip 4, in this embodiment, is made up of spindle or bar 11 and head 12.

Said spindle or bar 11 is immovably fitted into base 3 of pellet 8. Spindle or bar 11 fits inside body 6. Lateral grooves 14 are arranged to remove any air left inside body 6 that would be trapped between the referred body 6 and spindle 11.

Simple pressure of the interior walls of body 6 is enough to secure spindle 11 inside body 6. The inventors have arranged for gripping means at base 3 inside body 6 (as in FIG. 3), comprising transversal projections 17 on spindle 11 that act as hooks on base 3 when inserted into body 6, so that spindle 11 is able to move down towards base 3 of body 6, but they grip the walls of body 6 like hooks if extraction is attempted, thus preventing its exit.

The referred gripping means could also be vertical projections 20 located inside base 3 that apply pressure to the walls of spindle or bar 11, defining lateral grooves 14 between adjacent vertical projections, which would also allow air to be removed.

It could also be optionally thought that the gripping means were slots in base 3 for threading on spindle or bar 11 etc.

There is a stud or protuberance 15 at the bottom of hollow body 6, which protrudes inside hollow body 6 and on which the base of spindle 11 is positioned. Said stud 15 would initially only come into contact with the base of spindle 11. The use of said stud 15 will minimise the effects of possible defects of the parts, such as burrs. This provides better exactness and less deviation of lateral wall 13.

This means that if the base of spindle or bar 11 is not cut correctly, for example, cut at a certain angle, said stud 15 would enable such a defect to be corrected because it applies pressure to the centre of the base of spindle 11 so that any angled cutting imperfections are eliminated by balancing the base of spindle 11.

Head 12 is fixed by upper zone 9 of head 2. Said head 12 is part of tip 4, which protrudes beyond the top of pellet body 6 and strikes the target.

In this embodiment, the part of tip 4 of head 12 that is visible from the outside is round.

It is also possible for head 2 of the pellet to be a continuation of the lines or geometry of the exterior part of tip 4 or head 12.

This invention describes a new pellet for sporting rifles and sporting guns. The examples mentioned here do not limit this invention and, for this reason, it may have various applications and/or adaptations, all of which within the scope of the following claims.

The invention claimed is:

1. A pellet for sporting rifles and sporting guns comprising:

a hollow body comprising a body head portion joined to a body base portion, and an upper zone, the body having an internal surface and an external surface;

a tip having an external surface and fixed in an immobile manner inside the hollow body, wherein the tip comprises a spindle or bar portion having a first diameter, a tip head portion comprising a lower part and a lateral wall, the lower part connected to a beginning of the spindle or bar portion and transitioning from the first diameter to the lateral wall, the lateral wall having a constant second diameter over a predefined height, wherein the second diameter is larger than the first diameter, and a space or cavity defined between the internal surface of the body and the external surface of the tip in the lower part of tip head portion and the beginning of spindle or bar portion, wherein said body comprises elastic material, at least in a deformable zone that defines said space or cavity one or more portions of external surface of body are wider in diameter than a diameter of the upper zone, and the internal surface of the upper zone of said body is in contact with the external surface of the lateral wall of the tip at least along a portion of the lateral wall height.

2. The pellet according to claim 1, wherein base consists of elastic materials.

3. The pellet according to claim 1, wherein base comprises exterior fins that define a lower cavity.

4. The pellet according to claim 1, further comprising an absorption zone at an end of body head portion.

5. The pellet according to claim 4, wherein the absorption zone comprises a step defined by the tip, which absorption zone comprises a portion of lateral wall that extends beyond an upper perimeter of the body head portion.

6. The pellet according to claim 4, wherein the upper zone of body head portion in contact with the tip comprises reinforced material.

7. The pellet according to claim 1, wherein the tip fits inside the base of the pellet, and the tip lateral wall is fixed by the upper zone of the body head portion and protrudes from the top of the body.

8. The pellet according to claim 7, wherein a base zone of the body comprises internal comprises lateral grooves configured to permit air to escape between the internal surface of the body and the external surface of the tip when the tip is inserted within the body.

9. The pellet according to claim 7, wherein the spindle or bar comprises gripping means configured to grip the base.

10. The pellet according to claim 1, wherein said gripping means for the base comprise threads.

11. The pellet according to claim 1, wherein said gripping means for the base comprise transversal projections on the spindle or bar.

12. The pellet according to claim 7, wherein the base comprises gripping means configured to grip the spindle or bar.

13. The pellet according to claim 7, further comprising a stud or protuberance at a bottom of the hollow body on which a base of the spindle or bar is positioned.

14. The pellet according to claim 1, wherein a portion of the tip extends beyond the body and has a rounded geometry.

15. The pellet according to claim 1, wherein the head portion of the body of the pellet has lines or geometry that are a continuation of lines or geometry of an exterior part of the head portion of the tip.

16. The pellet of claim 12, wherein the gripping means comprise vertical projections inside the base that press against spindle or bar and define lateral grooves between adjacent vertical projections.

17. The pellet of claim 16, wherein one or more portions of external surface of body are wider in diameter than a diameter of the upper zone.

18. A pellet for sporting rifles and sporting guns comprising:

a hollow body comprising a body head portion joined to a body base portion, and an upper zone, the body having an internal surface and an external surface;

a tip having an external surface and fixed in an immobile manner inside the hollow body, wherein the tip comprises a spindle or bar portion having a first diameter, a tip head portion comprising a lower part and a lateral wall, the lower part connected to a beginning of the spindle or bar portion and transitioning from the first diameter to the lateral wall, the lateral wall having a constant second diameter over a predefined height, wherein the second diameter is larger than the first diameter, and a space or cavity defined between the internal surface of the body and the external surface of the tip in the lower part of tip head portion and the beginning of spindle or bar portion, wherein the internal surface of the upper zone of said body is in contact with the external surface of the lateral wall of the tip at least along a portion of the lateral wall height.

19. The pellet of claim 16, wherein said body comprises elastic material, at least in a deformable zone that defines said space or cavity.

* * * * *

UNITED STATES PATENT AND TRADEMARK OFFICE

CERTIFICATE OF CORRECTION

PATENT NO. : 9,157,711 B2
APPLICATION NO. : 13/817600
DATED : October 13, 2015
INVENTOR(S) : Victor Tresserras Torre et al.

It is certified that error appears in the above-identified patent and that said Letters Patent is hereby corrected as shown below:

In the Claims

At column 5, line 14 of the Letters Patent, in claim 8 (original claim 8), "the body comprises internal comprises lateral grooves" should read --the body comprises internal lateral grooves--.

Signed and Sealed this
Second Day of August, 2016

Michelle K. Lee

Michelle K. Lee
*Director of the United States Patent and Trademark Office*